US006522764B1

(12) United States Patent
Bøgeskov-Jensen

(10) Patent No.: US 6,522,764 B1
(45) Date of Patent: Feb. 18, 2003

(54) HEARING AID

(75) Inventor: Tom Bøgeskov-Jensen, Hellerup (DK)

(73) Assignee: Oticon A/S, Hellerup (DK)

( * ) Notice: Subject to any disclaimer, the term of this patent is extended or adjusted under 35 U.S.C. 154(b) by 0 days.

(21) Appl. No.: 09/807,002

(22) PCT Filed: Oct. 7, 1999

(86) PCT No.: PCT/DK99/00532

§ 371 (c)(1),
(2), (4) Date: May 18, 2001

(87) PCT Pub. No.: WO00/21333

PCT Pub. Date: Apr. 13, 2000

(30) Foreign Application Priority Data

Oct. 7, 1998 (DK) ..... 1998 01267

(51) Int. Cl.[7] ..... H04R 25/00
(52) U.S. Cl. ..... 381/330; 381/322
(58) Field of Search ..... 381/322, 324, 381/330, FOR 134, FOR 135; 181/129, 132

(56) References Cited

U.S. PATENT DOCUMENTS 3,239,093 A * 3/1966 Gath
3,828,142 A * 8/1974 Buttner
5,062,138 A 10/1991 Schmid
5,708,720 A * 1/1998 Meyer
6,041,128 A * 3/2000 Narisawa et al. ..... 381/322

FOREIGN PATENT DOCUMENTS

| | | |
|---|---|---|
| CH | 673364 | 2/1990 |
| CH | 687897 | 3/1997 |
| DE | 4035506 | 5/1992 |
| EP | 0416155 | 3/1991 |
| JP | 60-26196 | * 12/1985 |

* cited by examiner

*Primary Examiner*—Sinh Tran
(74) *Attorney, Agent, or Firm*—Dykema Gossett PLLC

(57) ABSTRACT

The invention relates to a hearing aid comprising a housing with at least one acoustic inlet opening and at least one acoustic outlet opening, the housing containing a microphone in connection with the acoustic inlet opening, an amplifier in connection with the microphone, a receiver in connection with the amplifier and a battery for power supply, the housing being provided with a hook for transmittal of acoustic signals from the receiver into the ear of the user, the housing comprising two connectable and detachable parts. The hearing aid is characterized in the means for provided on each housing part for mutually snap locking the parts.

6 Claims, 5 Drawing Sheets

HEARING AID

BACKGROUND FOR THE INVENTION

The invention relates to a hearing aid comprising a housing with at least one acoustic inlet opening and at least one acoustic outlet opening, where the housing contains a microphone, an amplifier in connection with the microphone, a receiver in connection with the amplifier and a battery for power supply, where the housing is provided with a hook for transmittal of acoustic signals from the acoustic outlet opening into the ear of the user, the housing comprising two connectable and detachable parts.

A hearing aid of this type is well known within the art of hearing aids as a so-called BTE hearing aid. Normally the two parts of the housing are maintained in a mutually fixed position by means of separate fastening means such as screws or the like. The result of this is that the material in the housing parts at the area of fastening is significantly stressed, which may lead to breakage of the material in these areas. This is especially the case when a hearing aid is dropped on a hard surface, which happens occasionally. In this situation the already stressed housing material may break more easily if not dimensioned for the additional stress. This means that the hearing aid housing may comprise more housing material than necessary for resisting the impact applied when the hearing aid is dropped. More material means more weight and hence an increased discomfort for the user. Furthermore the assembly by means of such housing parts by means of fastening means such as screws is a delicate and time-consuming process due to the very small sizes of the fastening means.

CH 673364 discloses a hearing aid with a housing comprising two parts, which are mutually interconnected by means of one or more clamps. This construction is difficult to handle due to the very small size of the clamps. The clamps furthermore must provide a significant spring force in order to maintain the position of the housing parts, which makes the mounting of these extremely difficult.

CH 687897 discloses a similar construction, presenting similar disadvantages.

EP 416155 discloses a hearing aid with a housing comprising two parts, which are mutually interconnected by means of a snap connection. The construction is likely to vibrate and the resonance of such vibration will be very disturbing for the user of the hearing aid.

U.S. Pat. No, 5,062,138 discloses a hearing aid with a housing comprising two parts, which are mutually interconnected by means of a snap connection. The construction is likely to vibrate and the resonance of such vibration will be very disturbing for the user of the hearing aid.

The objective of the present invention is to provide a hearing aid which may be assembled without inflicting stress on the housing parts, which may be assembled in a less time consuming manner i.e. which is easier to assemble and which is less prone to resonate due to vibrations in the housing parts.

SUMMARY OF THE INVENTION

According to the invention this is obtained by a hearing aid of the type mentioned in the introductory part of the description and which is characterized in that means are provided on each housing part for mutually snap locking the parts.

Hereby the fastening elements may be omitted and the stress impact of these is no longer present. Hence the housing may be dimensioned with a smaller strength and still resist impact if the user accidentally drops the hearing aid. The assembling of the hearing aid is furthermore significantly facilitated.

In a preferred embodiment a protruding element is provided in one of the two detachable parts, preferably in the vicinity of the acoustic inlet opening, and an opening is provided in the other of the two detachable parts and being adapted to receive the protruding element. There may be more acoustic inlet openings, preferably two, where in connection with each of these a protruding element may be provided. The second detachable part has a corresponding number of openings for receiving the protruding element. A further possibility comprises providing a protruding wall around each opening.

In a further preferred embodiment one of the housing parts comprises an arm having a barb is provided at one end of one of the two detachable parts.

In a still further preferred embodiment the housing parts are separated along their sides and that mutually cooperating guide means are provided at the side edges of the respective elements.

In another preferred embodiment the housing parts are separated along their sides and stays are provided at the sides of one of the housing parts and that corresponding holes are provided in the other housing part.

DESCRIPTION OF A PREFERRED EMBODIMENT

Figure 1:
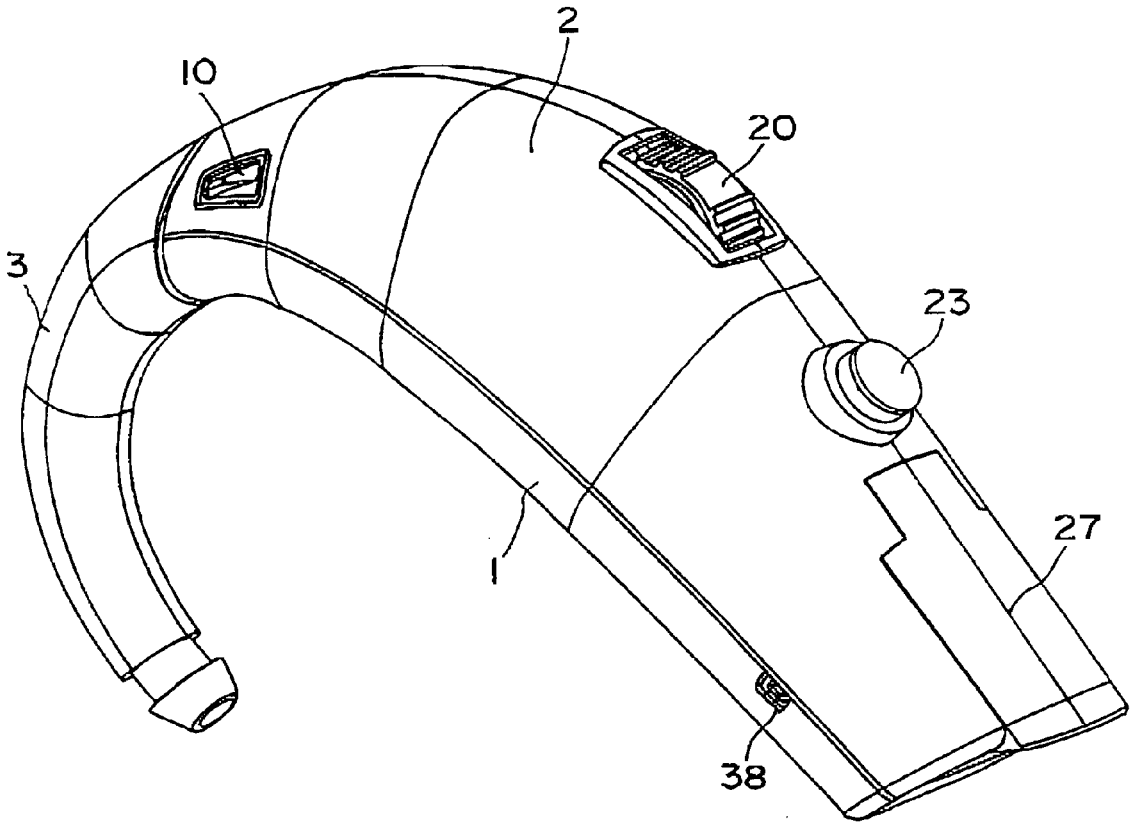
FIG. 1 is a perspective view of a hearing aid according to the invention.

From FIG. 1 a hearing aid appears, which comprises a housing divided into two shell parts, a first shell part 1 and a second shell part 2. At the upper end of the housing a hook is mounted in an adapter part. An acoustic inlet opening 10 appears as well as a volume control 20, an activating button 23 and a battery drawer 27. An aperture 38 for accessing a battery terminal appears.

Figure 2:
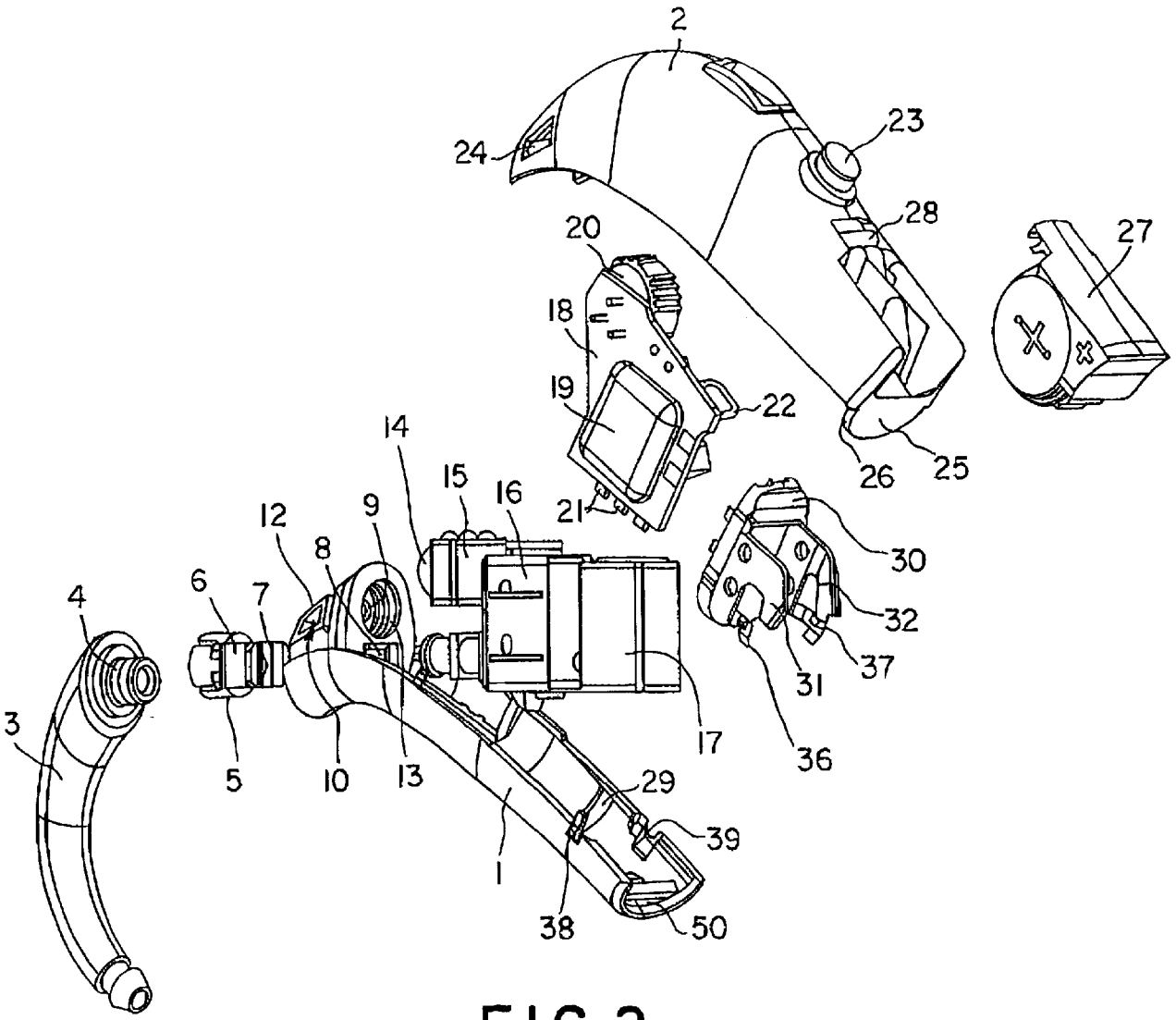
FIG. 2 is a exploded perspective view of the hearing aid of FIG. 1.

From FIG. 2 an exploded view of the hearing aid shown in FIG. 1 appears. The hook 3 comprises a circumferential recess 4 at the coupling end. It appears that the hook is mounted in an adapter part 5, which is mounted in an aperture in the first shell part 1 and is held in place by means of two flexible legs 6,7 having at their outer ends barbs cooperating with internal shoulders around the aperture 8 in the first shell part. The opposite end of the adapter 5 comprises four flexible wall parts separated by incisions and having internal barbs adapted to cooperate with the recess 4 in the hook 3.

The first shell part comprises an acoustic inlet channel which at the outer end is branched into two opposed acoustic inlet openings 10,11 located at the sides of the first shell part. A thin protruding well 12 surrounds each inlet opening. At the inner end the channel faces a cavity 13 for holding a microphone suspension 14 which holds the microphone 15. Beneath the cavity 13 for holding the microphone suspension and the microphone the above-mentioned aperture 8 for the hook adapter is situated. A receiver 17 is adapted to be placed in a receiver suspension 16, which is inserted into the aperture and into the adapter. The outer end of the suspension forms a seal against the hook 3 when this is mounted in the hook adapter.

In the first shell part holding means are provided for receiving and holding a circuitry board 18 which on its side holds an amplifier 19, a volume control 20, a telecoil (not visible), programming terminals 21 and a switch 22 adapted to be activated by the activating button 23. These holding means comprise holding slots 33,34 (see FIG. 3) for the end areas of the board at one side edge of this. This means that the board is fixed in transversal as well as longitudinal translation and may only be inserted and removed in a direction parallel to the board plane. Between the slots apertures 49 for the programming terminals on the circuitry board are provided for allowing access to these from the outer surface of the housing. At the end of the first shell part a locking recess 50 is provided. A recess 29 is provided for receiving a terminal wall 30 being provided with terminals 31,32 for contacting the battery and further terminal 36,37 for external access through apertures 38,39.

The second shell part comprise apertures 24 for receiving and surrounding the protruding walls 12 around the acoustic inlets 10,11 on the first shell part. At the opposite end of the second shell part a locking arm 25 having a barb 26 is provided. This locking arm 25and the barb 26 together with the apertures 24 at the opposite end of the second shell part and the protruding wall 12 and the locking recess 50 on the first shell part forms the releasable locking means of the two shell parts. In the second shell part the battery drawer is mounted to be pivotable around a shaft 28. The two shell parts may be dismantled using a tool which comprises two arms adapted to be inserted between the first and the second shell part in the area where these are mutually connected at the acoustic inlets. Upon insertion the second shell part will be expanded to a state where this may be lifted away from the protruding wall parts and hereby may be released from the first shell part.

The assembling of the hearing aid is carried out by fixing the first shell part and hereafter placing the microphone suspension in the aperture adapted for this purpose. Afterwards the microphone is placed in the microphone suspension. The receiver suspension is mounted and the receiver is mounted in the receiver suspension. Following that the terminal wall is mounted in the first shell part and the circuitry board is inserted. The electrical connection between the circuitry board and the terminal is achieved by abutment of the free ends of the terminals with contact pads on the circuitry board. Afterwards the second shell part is mounted on the first shell part by snap locking. The battery drawer is mounted in the second shell part and the hook is mounted in the housing.

Figure 3:
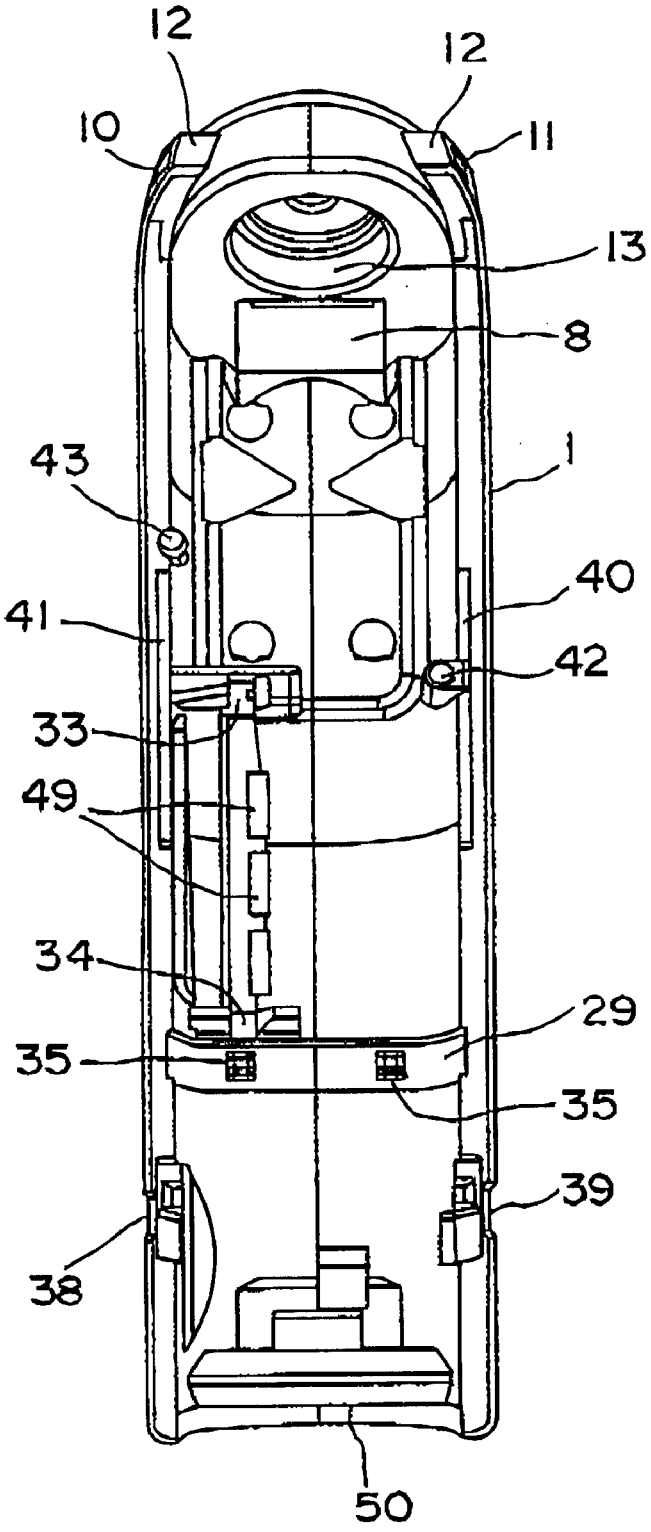
FIG. 3 is a top view of one of the housing parts.

From FIG. 3 the wall elements 12 surrounding the inlet openings 10,11 appear. It appears that the lower edge of the wall element will retain the second shell part against an upward directed movement. At the opposite end of the first shell part a recess 50 is provided, which is adapted for receiving a barb 26 on an arm 25 of the second shell part. Furthermore guide rails 40,41 on the first shell part appear as well as stays 42,43 for increasing the rigidity of the construction, especially against pressure from the side, These elements 40–43 cooperate with apertures or recesses 44–47 in the second shell part. Guide taps for the terminal wall in the recess 29 appears as well.

Figure 4:
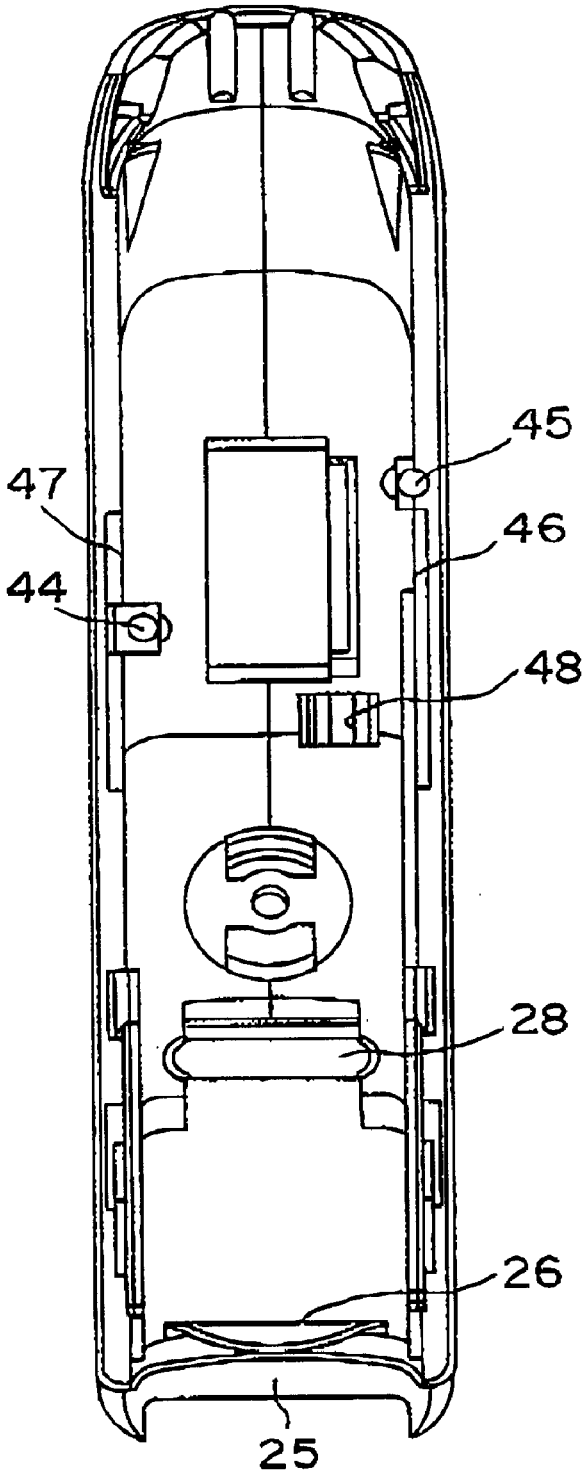
FIG. 4 is a bottom view of the other of the housing parts.
Figure 5:
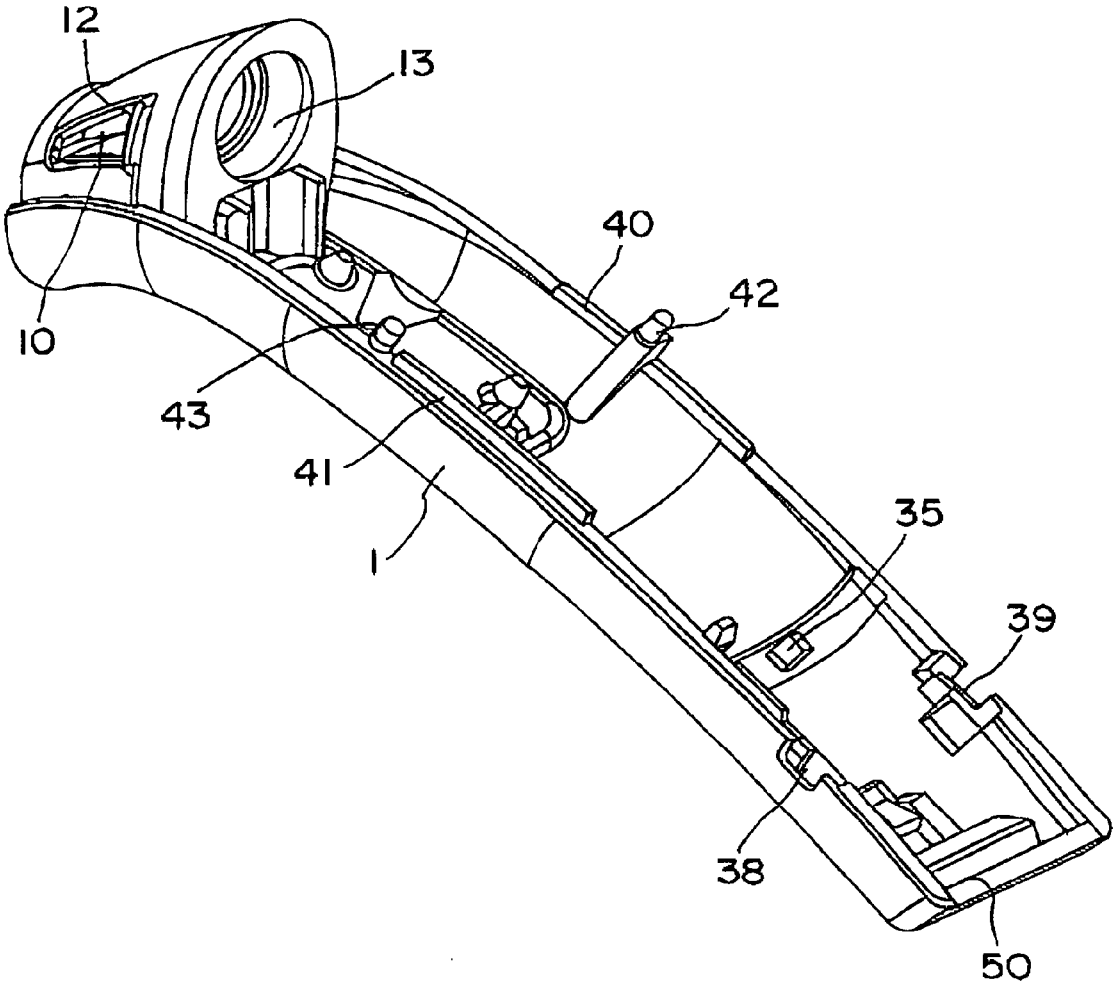
FIG. 5 is a perspective view of the housing part shown in FIG. 3.

From FIG. 4 the arm 25 with the locking barb 26 appears. Furthermore the holes 44,45 for receiving the stays of the first shell part appears as well as the recesses 46,47 for receiving the guide rails of the first shell part. Furthermore a holding means 48 for holding the circuitry board at a side edge opposite the one held in the first shell part is provided in the second shell part. The stays and the guide rails of the first shell part appear more clearly from FIG. 5.

What is claimed is:

1. A hearing aid comprising a housing with two acoustic inlet openings and at least one acoustic outlet opening, where the housing contains a microphone in connection with the acoustic inlet openings; an amplifier in connection with the microphone, a receiver in connection with the amplifier and a battery for power supply, the housing being provided with a hook for transmittal of acoustic signals from the acoustic outlet opening into the ear of the user, where the housing comprises two connectable and detachable parts, where means are provided on each housing part for mutually snap locking the housing parts characterized in that the means for mutually snap locking the two housing parts comprises protruding elements, each at least partly surrounding each inlet opening, and that two apertures are provided in the other of the two housing parts to receive the protruding elements.

2. A hearing aid according to the claim 1, wherein the protruding elements are provided in one of the two connectable and detachable parts and that in the other of the two connectable and detachable parts the apertures are provided and being adapted to receive the protruding elements of the first of the connectable and detachable parts.

3. A hearing aid according to claim 1, wherein the protruding element totally surrounds the inlet opening.

4. A hearing aid according to claim 1, including an arm having a barb at one end of one of the two connectable and detachable parts.

5. A hearing aid according to claim 1, wherein mutually cooperating guide means are provided at the side edges of the respective housing parts.

6. A hearing aid according to claim 1, wherein and that stays are provided at the sides of one of the housing parts and that corresponding holes are provided in the other housing part.

* * * * *